US006898885B1

(12) United States Patent
Nagel

(10) Patent No.: US 6,898,885 B1
(45) Date of Patent: May 31, 2005

(54) LABEL HOLDER ASSEMBLY WITH END SIGN

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 10/602,328

(22) Filed: Jun. 24, 2003

Related U.S. Application Data

(60) Provisional application No. 60/476,110, filed on Jun. 6, 2003.

(51) Int. Cl.[7] ..... G09F 3/18
(52) U.S. Cl. ..... 40/661.06; 40/666; 40/649
(58) Field of Search ..... 40/649, 661.03, 40/661.06, 661.07, 658, 666

(56) References Cited

U.S. PATENT DOCUMENTS 5,197,215 A * 3/1993 Torsleff ..... 40/654.01
5,967,343 A * 10/1999 Dufresne ..... 211/86.01
6,266,906 B1 * 7/2001 Nagel ..... 40/661.03

* cited by examiner

*Primary Examiner*—Joanne Silbermann
(74) *Attorney, Agent, or Firm*—Schweitzer Cornman Gross & Bondell LLP

(57) ABSTRACT

A combination label holder and sign, where the label holder component is of extruded construction and the sign component is inexpensively formed of sheet plastic material, printed with text and/or graphics on both sides and removably attached to the label holder component. The label holder component includes a clip, for attachment to a peg hook or shelf front, integrally attached to a label holder by means of a thin, flexible hinge. The label holder has front and back panels, joined at the bottom to form a label-holding pocket. A sign-holding channel is formed on the back panel of the label holder by a pair of horizontally disposed, spaced apart channel-forming flanges. The sign-holding channel slidably receives a mounting tongue portion of the sign component. The main body of the sign component extends outwardly at right angles from the label holder and its graphics are visible from opposite sides to customers walking in either direction in a merchandise aisle. The sign components can be easily installed, removed and/or exchanged by sliding the tongue portions thereof out of the channels retaining them and, if new signs are to be installed, re-inserting tongue portions thereof into the label holder channels.

6 Claims, 4 Drawing Sheets

LABEL HOLDER ASSEMBLY WITH END SIGN

RELATED APPLICATIONS

This application is based upon, and claims the priority of, provisional application Ser. No. 60/476,110, filed Jun. 6, 2003.

BACKGROUND OF THE INVENTION

In connection with the mass marketing of products, whether displayed on pegboard hooks or shelving, it is frequently desired to mount special attention-getting signs or labels. One of the mechanisms used for this purpose is a so-called "talker" which comprises a large-size sign, which can be removably attached to a label holder, either at the front of a shelf or at the forward end of a pegboard, for example. The so-called "talker" device includes as its significant element an outwardly-extending sign tab, which is visible to persons walking up and down the shopping isle, and which carries an attention-getting message or indicia, typically on both surfaces thereof so as to be readable to shoppers walking in either direction.

Often, the outwardly projecting sign element is of relatively large size. Accordingly, it is usually desired to impart a hinging action to the assembly, so that a customer contacting the lower edge of the device while withdrawing a product from the display simply displaces the element outwardly and upwardly.

In a typical case, a label-holding device, whether intended for mounting on a shelf front or on a peg hook, for example, can be economically manufactured by extrusion procedures. The "talker" element, on the other hand, because it requires printing with text and or graphics, is, most economically produced by printing the desired text and or graphics on flat sheet plastic material. After the printing operation, the sheet material is die cut to the desired size and then bent as necessary for attachment to the label-holding component.

Known devices of this general type have suffered from disadvantages associated with the difficulty of assembling the "talker" element with the label-holding element, and or the reliability of such assemblies when accomplished.

SUMMARY OF THE INVENTION

Pursuant to the invention, the label holder assembly comprises separate label holder and sign components. The label holder component is of extruded plastic construction and is comprised of a mounting portion and a label holding portion. The mounting portion is adapted to be secured in more or less fixed relation on the end of a peg hook, for example, or in the ticket channel typically found at the front edge of a display shelf. The specific configuration of the mounting portion will of course be a function of the element on which it is to be mounted. The label holding portion typically comprises front and back panels, integrally secured along their bottom edges to form an upwardly openable label-holding pocket. At least the front panel is of clear, transparent material, such that the label information is readily visible. To particular advantage the mounting portion and the label holding portion are secured together by an integral flexible hinge element joining upper portions of each, such that, with the mounting portion generally fixed in position, the label holding portion can easily pivot outwardly and upwardly if engaged by a customer when withdrawing a product from a merchandise display.

The back panel of the label holding portion advantageously is formed with a channel for slideably receiving and frictionally engaging a horizontal tongue portion of the sign component, by means of which the sign is removably attached to the label holding element in a uniform and reliable manner, while at the same time enabling removal and/or replacement from time to time as appropriate to the desires of the merchandiser.

For a more complete understanding of the above, and other features and advantages of the invention, reference should be made to the following detailed description of a preferred embodiment, and to the accompanying drawings.

DESCRIPTION OF PREFERRED EMBODIMENTS

Figure 1:
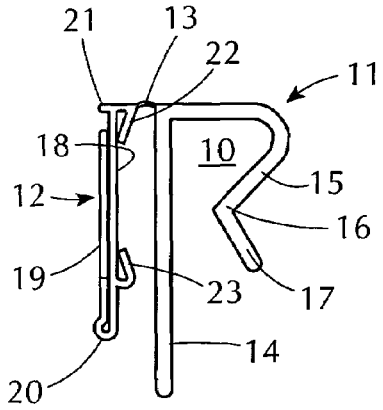
FIG. 1 is an elevational view of a label holder component according to the invention, adapted for mounting at the end of a peg hook.
Figure 2:
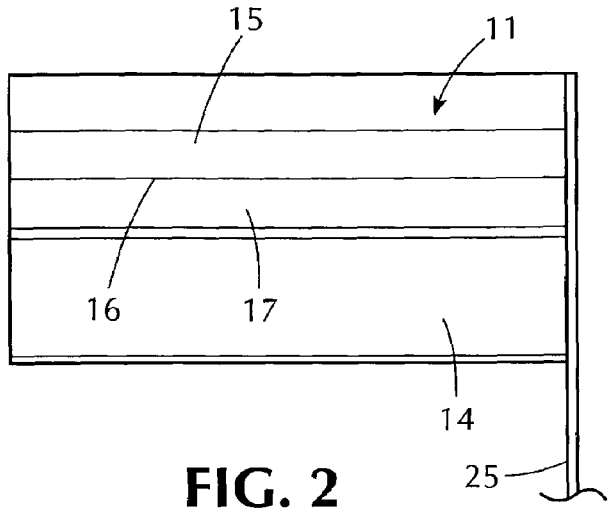
FIG. 2 is a back elevational view of the label holder component of FIG. 1.

Referring now to the drawings, and initially to FIGS. 1 and 2, a label holder component according to the invention, designated by the reference 10, is comprised of a mounting portion 11 and a label holder portion 12 connected at upper edges of each by a thin, flexible hinge section 13. The label holder component 10 is extruded of plastic material, preferably clear polyvinyl chloride (PVC) and thus is of uniform cross-section throughout. The device of FIGS. 1 and 2 is intended for mounting at the front end of a peg hook, for example, and thus is cut to a suitable length that purpose, typically from about 1½ to about 3 inches.

In the invention illustrated in FIG. 1, the mounting portion 11 is adapted to be fitted over a plate at the front of a peg hook, and thus includes a clip portion 15 joined with a flat panel 14 at upper edge of both. The clip portion 15 extends rearwardly, and then downwardly, forming a convergent throat 16 for gripping the front plate of the peg hook, and a guide flange 17 to facilitate mounting.

The label holder portion 12 of the assembly includes a flat back panel 18 and a flat front panel 19, joined by a hinge portion 20 extending along the lower edges of the panels. A label-holding pocket is formed between the panels 18, 19, and preferably a short, forwardly projecting flange 21 extends from an upper edge of the back panel 18 to minimize the entry of dust etc. into the label pocket.

Pursuant to the invention, the back panel 18 of the label holding portion is formed with upper and lower opposed channel-forming flanges 22, 23. These channels are spaced apart a distance of approximately ½ inch and extend horizontally along the full width of the back panel 18.

Figure 5:
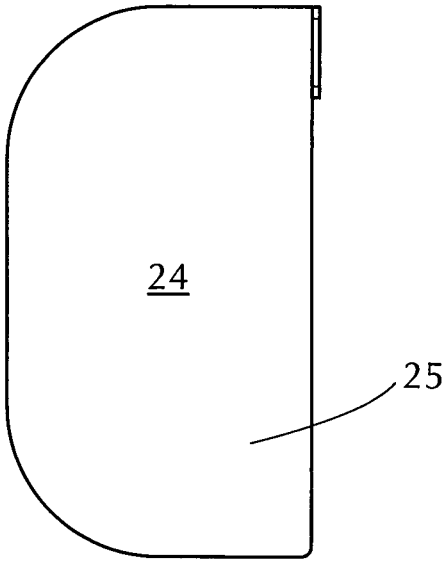
FIG. 5 is an end elevational view of the sign component adapted for assembly with the label holder components of FIGS. 1–4.
Figure 6:
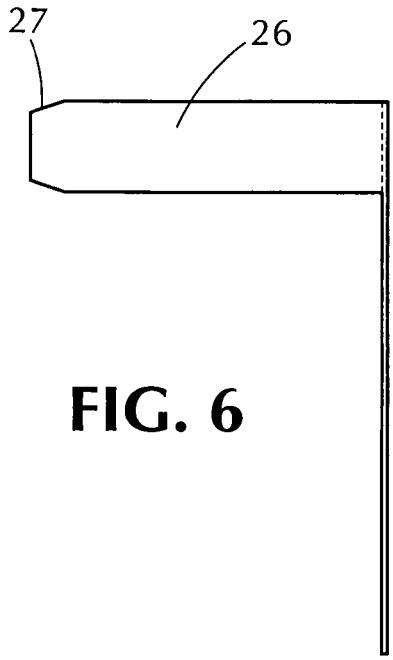
FIG. 6 is a back elevational view of the sign component of FIG. 5.
Figure 7:
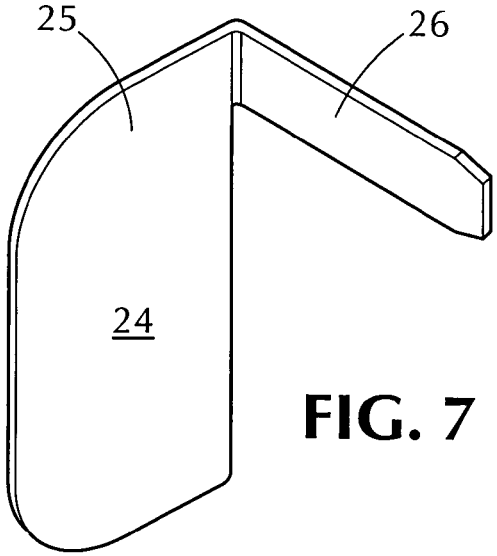
FIG. 7 is a perspective view of the sign component of FIG. 5.

A sign or "talker" component 24, such as shown in FIGS. 5–7 is assembled with the label-holder component 10 in a manner hereinafter described. The sign component 24 preferably is formed of sheet plastic material, for example 30 mil PVC and includes a printed portion 25 and a mounting portion 26. The printed portion 25 is printed with text and/or graphic material while the plastic sheet material is in flat form, suitable for convenient and economical handling by conventional printing equipment. After printing has been completed, the sheet material is die cut to the combined shape of the sign and mounting portions 25, 26. Thereafter, the two portions are bent at right angles, as reflected in FIG. 7. Preferably, the mounting portion 26 is positioned adjacent and upper edge of the sign portion 25, as illustrated.

To assemble the sign component 24 to the label holding component 10, the mounting portion 26 is inserted laterally into the channels defined by the channel-forming flanges 22, 23. To this end, the leading end of the mounting portion 26 is tapered at 27, to facilitate entry. Once fully inserted, the sign portion 24 is positioned tightly against an end edge of the label holding portion 12, as indicated in FIG. 2. The channel-forming flanges 22, 23, tightly grip mounting portion 26 so that the sign component 24, once assembled together with the label holding 5; component 12 remains in its assembled relation unless intentionally removed.

Preferably, the text and/or graphic material printed on the sign portion 25 is printed on both sides thereof, so as to be visible to customers walking in either direction along a shopping aisle. When the sign component 24 has served its intended purpose, for example to emphasize non-sale items, newly added merchandise, etc., it can be removed and discarded, and later replaced with another sign component carrying a different message.

The described structure enables a merchandise display to be provided with a"talker" sign on a basis which is both highly economical from a manufacturing standpoint, and also from the standpoint of minimizing in-store labor involved in the installation and removal of the sign components.

Typically the sign portion 25 has a vertical dimension substantially greater than, and desirably a multiple of, the vertical dimension of the mounting portion 26. For example, in a preferred embodiment, the mounting portion may have a vertical dimension of about a half inch, whereas the sign portion may have a vertical dimension of around three inches. The label holder component may in some cases have a vertical dimension similar to that of the sign portion, but in many cases will have a considerably smaller vertical dimension.

Figure 8:
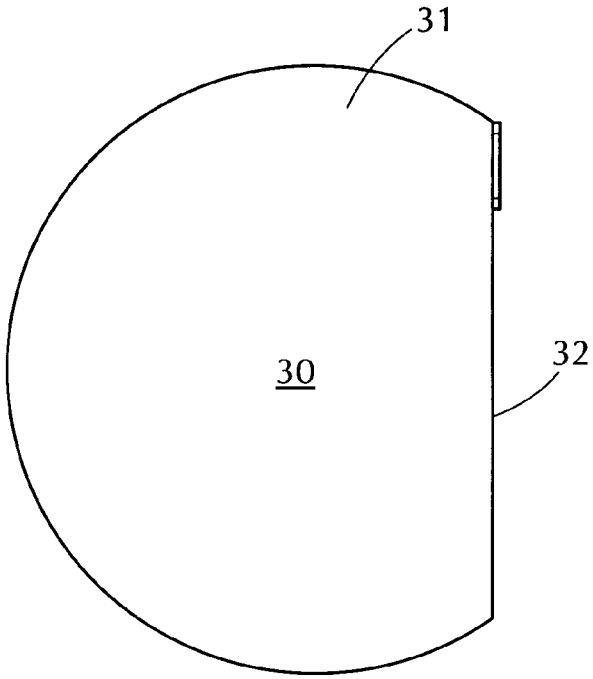
FIGS. 8, 9 and 10 are an end elevation, back elevation and perspective views respectively of a modified form of sign component for mounting on the label holder component of FIGS. 1–4.
Figure 9:
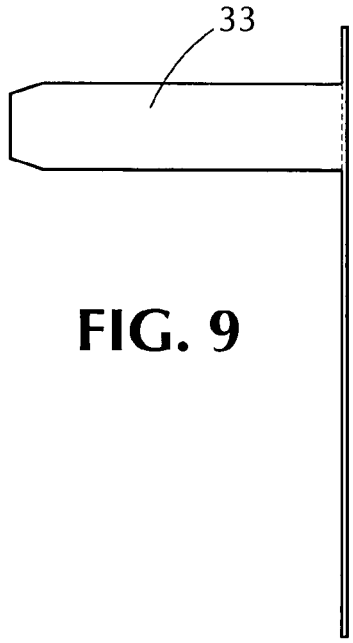
Figure 10:
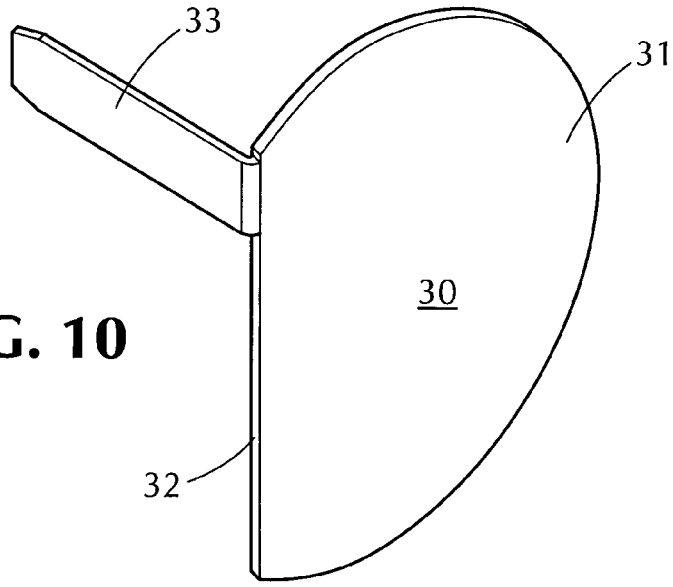

FIGS. 8–10 illustrate a modified form of sign component 30 comprising a large sign portion 31 of generally circular configuration, having one flat edge 32. A mounting portion 33 extends from an upper portion of the flat edge 32, and provides means for mounting of the sign component on the label holding component.

As with the sign component 24, FIGS. 5–7, the sign component 30 is preferably formed of flat sheet plastic material, with the sign portion 31 printed on both sides and the item thereafter being die cut and bent to the form shown in FIG. 10.

Figure 3:
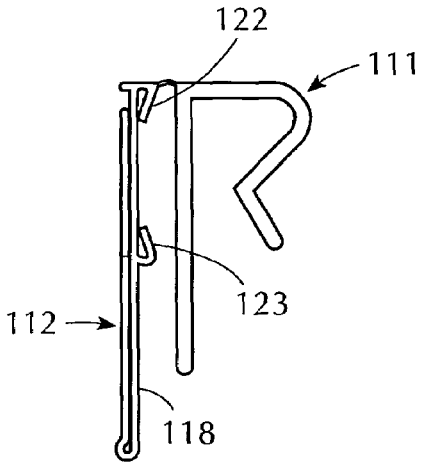
FIG. 3 is an end elevational view similar to FIG. 1, of a label holder component for a larger size label.
Figure 4:
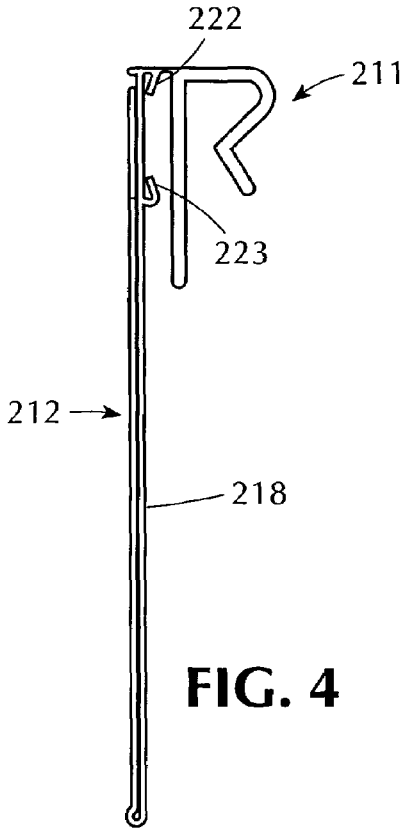
FIG. 4 is an end elevational view of a label holder component, similar to FIG. 1, for a still larger size label holder.

FIGS. 3, 4 illustrate modified forms of the label holder component of FIGS. 1, 2. To advantage, the clip portions 111, 211 may be identical to the clip portion 11 of FIGS. 1, 2. The respective label holder portions 112 and 212 are of greater depth, for the accommodation of labels of larger dimensions.

As will be evident in FIGS. 3 and 4, channel-forming flanges 122, 123 and 222, 223 are formed on the back panels 118, 218, adjacent the upper edges of each. The channel-forming flanges are spaced apart the same distance as, and function the same as, the channel-forming flanges 22, 23 of the embodiment of FIGS. 1 and 2, to accommodate the assembly of the sign components 24, 30 as previously described.

Figure 11:
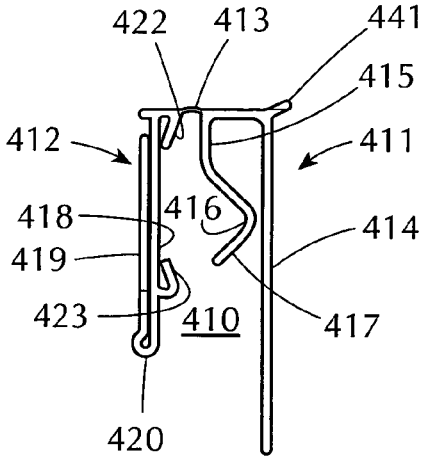
FIG. 11 is an end elevational view of the label holder component of a further embodiment of the invention, adapted for mounting in a price tag channel, for example, at the front of a display shelf.
Figure 12:
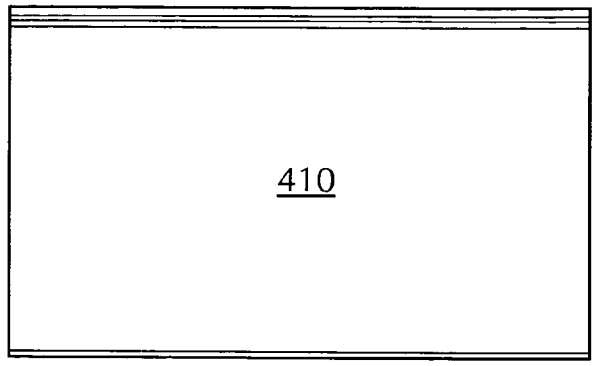
FIG. 12 is a back elevational view of the label holder component of FIG. 11.

The device of FIGS. 11, 12 is a further modified form of label holder component 410, suitably modified for mounting at the front of a display shelf, for example. The component 410 comprises a mounting portion 411 and a label holding portion 412 joined at upper edges of each by a flexible hinge 413. Mounting portion 411 is designed to be clipped onto the front barrier panel of a shelf, for example, or be inserted into a price ticket channel at the front edge of a shelf. To this end, the mounting portion includes a flat back panel 414 joined with a clip portion 415 configured to provide a narrow throat portion 416 and a guide flange 417. The clip portion 415 and panel 414 can be applied over the top edge of a shelf front barrier panel, for example. Likewise, the back panel 414, in conjunction with a short upwardly and rearwardly projecting flange 441 can be inserted into upper and lower grooves of a price ticket channel (not shown).

The label holder portion 412 of the embodiment of FIGS. 11, 12 can be essentially identical to that of the embodiment of FIG. 1, provided with back and front panels 418 and 419 respectively joined along the bottom edge by a hinge portion 420 to provide the label-holding pocket. Channel-forming flanges 422, 423 extending horizontally along upper portions of the back panel 419, serve the same functions as the channel-forming flanges 22, 23 of the embodiment of FIG. 1, for receiving and securing the mounting portion 26 or 33 of a sign component 24 or 30.

The essential function of the embodiment of FIGS. 11 and 12 is the same as that of FIGS. 1 and 2, the principal difference being in the form of the mounting portion 411, which is arranged for mounting at a shelf front, rather than at the front of a peg hook.

Figure 13:
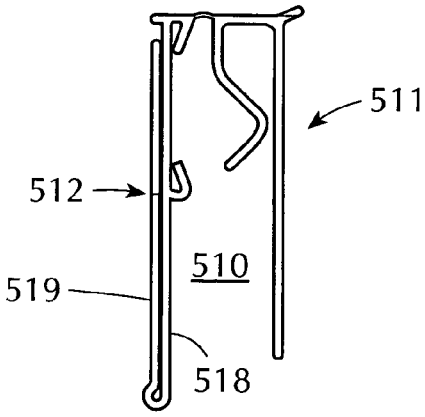
FIGS. 13 and 14 are end elevational views, similar to FIG. 11, of label holder components of larger sizes.
Figure 14:
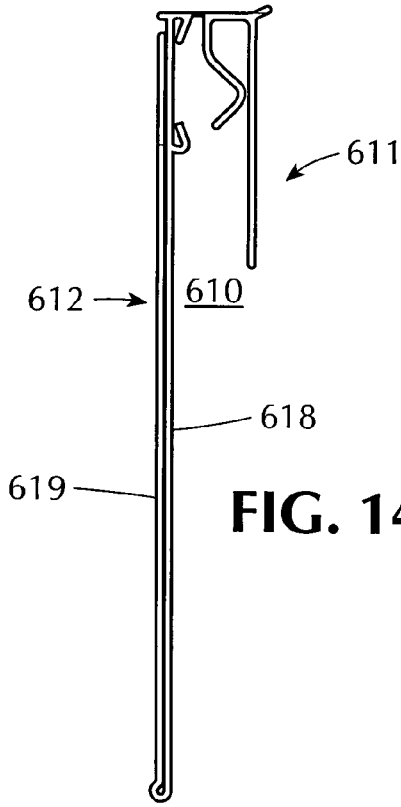

FIGS. 13 and 14 show label holder components 510, 610 that are functionally similar to the embodiment of FIGS. 11, 12, except that the label holding portions 512 and 612 thereof are of greater depth for the accommodation of larger labels in the label holding pockets formed between panels 518, 519 and 618, 619. The respective mounting portions 511, 611 can be identical to the mounting portion 411 of the embodiment of FIGS. 11, 12.

The device of the invention, in any of its various forms, optimizes the manufacturing and handling procedures required to produce and install a label holder carrying a "talker" sign. The label holder component in each case can be extruded with a common size of mounting portion joined with label holder portions of various sizes to suit the label requirements. A sign component in all cases is formed of flat, sheet plastic material, which is printed in its sheet form and then die cut and bent to form a laterally extending mounting portion and a forwardly extending sign portion printed on opposite surfaces. The mounting portion is arranged to have a lateral sliding frictional fit with channel-forming flanges provided along an upper portion of the back panel of the label holder portion. The assembly procedure is simplified and easily accomplished, yet provides a secure and reliable display device. When the sign component is no longer needed, it can be removed and saved or discarded and, if appropriate, replaced with another bearing a different message.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A two-part combination label holder and sign, which comprises (a) a label holder component of extruded plastic construction and comprising a mounting clip portion and a label holding portion, (b) said label holding portion comprising front and back panels joined along bottom edges of each and separable at top portions thereof to accommodate insertion of a label, (c) a thin, flexible hinge integrally joining upper portions of said label holding portion and said mounting clip portion to accommodate limited pivoting movement of said label holding portion relative to said mounting clip portion, (d) said back panel having, on the back surface thereof, a pair of vertically spaced apart, horizontally disposed channel-forming flanges thereon defining a sign mounting channel extending over the full width of said back panel, and (e) a sign component formed of a single sheet of plastic material and comprising an elongated tongue-like mounting portion and a sign portion disposed at right angles to said mounting portion, (f) said sign portion being printed on both sides thereof, (g) said tongue-like mounting portion being snugly slidably received in said horizontally disposed channel-forming flanges to mount said sign component with the sign portion thereof extending at right angles to and forwardly of said label holding portion.

2. A combination according to claim 1, wherein (a) said label holding portion has a predetermined vertical dimension, and (b) said sign portion has a vertical dimension substantially greater than the vertical dimension of said label holding portion, whereby portions of said sign portion extend substantially below lower edge portions of said label holding portion.

3. A combination according to claim 2, wherein (a) the tongue-like mounting portion of said sign component has a vertical dimension less than the vertical dimension of said label holding portion.

4. A combination according to claim 3, wherein (a) the vertical dimension of said sign portion is a multiple greater than two of the vertical dimension of said tongue-like mounting portion.

5. A combination according to claim 1, wherein (a) said clip portion comprises front and back clip portions adapted for mounting in fixed relation on a display structure, and (b) said label holding portion and said sign component are adapted for swinging movement relative to said clip portion.

6. A combination according to claim 1, wherein (a) said channel-forming flanges are formed on a back surface of said back panel, and (b) an upper one of said channel-forming flanges is connected to said flexible hinge.

* * * * *